US005979687A

United States Patent [19]

Hayes et al.

[11] Patent Number: 5,979,687

[45] Date of Patent: Nov. 9, 1999

[54] HIGH-STRENGTH CONTAINER WITH INTERIOR BUTTON LATCH

[75] Inventors: Thomas J. Hayes; Mark A. Erickson, both of McHenry, Ill.; Raj K. Mangla, Pittsford, N.Y.; Mark Spencer, Gurnee, Ill.; Michael J. A. Sagan, Marshall, Wis.

[73] Assignee: Tenneco Packaging Inc., Lake Forest, Ill.

[21] Appl. No.: 09/113,645

[22] Filed: Jul. 10, 1998

[51] Int. Cl.[6] ..... B65D 43/16

[52] U.S. Cl. ..... 220/4.23; 220/4.24; 220/835; 220/839

[58] Field of Search ..... 220/4.23, 4.24, 220/837, 839, 833–835, DIG. 13; D7/538, 540, 542; D9/425, 431

[56] References Cited

U.S. PATENT DOCUMENTS

| | | |
|---|---|---|
| D. 214,132 | 5/1969 | Niemoller . |
| D. 255,857 | 7/1980 | Zimmerman . |
| D. 256,308 | 8/1980 | Zimmerman . |
| D. 256,646 | 9/1980 | Painter et al. . |
| D. 259,774 | 7/1981 | Criscitiello, Jr. . |
| D. 269,323 | 6/1983 | Cillario . |
| D. 298,304 | 11/1988 | Meyer . |
| D. 340,882 | 11/1993 | Holtkamp, Jr. . |
| 3,149,747 | 9/1964 | Burgess . |
| 3,234,077 | 2/1966 | Reifers . |
| 3,565,146 | 2/1971 | Arnolos . |
| 3,771,712 | 11/1973 | Richards . |
| 4,030,850 | 6/1977 | Hyde . |

(List continued on next page.)

FOREIGN PATENT DOCUMENTS

| | | |
|---|---|---|
| 1 071 126 | 2/1980 | Canada . |
| 1 076 044 | 4/1980 | Canada . |
| 1 117 491 | 2/1982 | Canada . |
| 1 249 231 | 1/1989 | Canada . |
| 39 43 301 C2 | 12/1989 | Germany . |
| 1 418 897 | 12/1975 | United Kingdom . |

OTHER PUBLICATIONS

BonFaire Disposable Food Service Products Brochure. ©BonFaire by Placon Corporation, 1990.

*Plastics Engineering*, Oct., 1989, p. 10, illustrating BonFaire Microwaveable Packaging by Placon Corporation.

Ultra Pac, Inc. Brochure regarding Eco*Clear (Date unknown).

Gourmet Display Product Catalog, and in particular, pp. 10, 22–23 (Date unknown).

FIGs. 2A–2B Drawing (showing a top and a bottom perspective view of a container), IVEX Corp. (Date unknown).

FIGs. 3A–3B Drawing (showing a top and a bottom perspective view of a container), IVEX Corp. (Date unknown).

Hexquisite™ line of containers, FIGs 1–14; Tenneco Packaging Inc., Lake Forest, IL, p. 14 (Date unknown).

*Primary Examiner*—Stephen K. Cronin
*Assistant Examiner*—Nathan Newhouse
*Attorney, Agent, or Firm*—Arnold White & Durkee

[57] ABSTRACT

A plastic container comprises a lid and a base. The lid includes a top wall and a lid side wall extending downward from the top wall. The base includes a bottom wall and a base side wall extending upward from the bottom wall. In accordance with one aspect of the present invention, the lid includes a first stepped flange extending laterally outward from a lower portion of the lid side wall, and the base includes a second stepped flange extending laterally outward from an upper portion of the base side wall. Internal portions of the respective first and second stepped flanges form a button latch for securing locking the container in a closed position. In accordance with another aspect of the present invention, the lid side wall includes a plurality of facets interconnected at corners. The corners are arced outwardly in radial cross-sections taken generally perpendicular to the top wall and through the respective corners, and the facets are arced inwardly in a cross-section taken generally parallel to the top wall and through the facets.

23 Claims, 10 Drawing Sheets

U.S. PATENT DOCUMENTS

| | | | |
|---|---|---|---|
| 4,193,496 | 3/1980 | Barratt . | |
| 4,333,580 | 6/1982 | Sweigart, Jr. . | |
| 4,512,474 | 4/1985 | Harding . | |
| 4,771,934 | 9/1988 | Kalmanides . | |
| 5,046,659 | 9/1991 | Warburton . | |
| 5,092,479 | 3/1992 | Wells | 220/4.23 |
| 5,269,430 | 12/1993 | Schlaupitz et al. | 220/4.23 |
| 5,584,408 | 12/1996 | Orkisz | 220/4.23 |
| 5,897,011 | 4/1999 | Brilliant et al. | 220/4.23 |

HIGH-STRENGTH CONTAINER WITH INTERIOR BUTTON LATCH

FIELD OF THE INVENTION

The present invention relates generally to plastic containers for holding foodstuffs and the like and, more particularly, relates to a high strength plastic container having an internal button latch.

BACKGROUND OF THE INVENTION

Plastic food containers are subjected to abuse during storage, shipping, and handling. Such abuse can, for example, be applied by top loads and side loads. Top loads apply downward forces to a top portion of the container, while side loads apply inward forces to a side wall of the container. Such forces can damage the container and possibly damage its contents, thereby making the container and its contents unsuitable for presentation to consumers. Moreover, such forces can overcome any locking mechanism used to secure the container in a closed position, thereby causing the container to "pop" open and expose its contents. The exposed contents can become contaminated and therefore unsuitable for consumption.

To prevent the container from popping open in response to external forces, some existing containers employ a locking mechanism in the form of a button latch. With respect to a container including a lid and a base, a button latch generally includes a male button formed in an external flange of one of the lid and the base and a mating female recess formed in an external flange of the other of the lid and the base. To lock the container in a closed position, the male button is engaged within the female recess. The foregoing button latch is advantageous because it securely locks the container in the closed position. However, a drawback of existing button latches is that they are formed in the external flanges of the container. To accommodate the button latch, the portions of the external flanges forming the button latch must be wider than other flange portions. The wider external flange portions can lessen the aesthetic appeal of the container and increase the amount of valuable shelf space occupied by the container in a store.

Although manufacturers of plastic containers continually strive to improve the resistance of containers to top and side loads and to improve the locking mechanisms of containers, a need still exists for improvements in these areas.

SUMMARY OF THE INVENTION

A plastic container comprises a lid and a base. The lid includes a top wall and a lid side wall extending downward from the top wall. The base includes a bottom wall and a base side wall extending upward from the bottom wall.

In accordance with one aspect of the present invention, the lid includes a first stepped flange extending laterally outward from a lower portion of the lid side wall. The first stepped flange includes a first internal portion and a first external portion. The first internal portion extends laterally outward from the lower portion of the lid side wall. The first external portion is vertically spaced from and extends laterally outward relative to the first internal portion. The base includes a second stepped flange extending laterally outward from an upper portion of the base side wall. The second stepped flange includes a second internal portion and a second external portion adapted to oppose the respective first internal portion and the first external portion. The second internal portion extends laterally outward from the upper portion of the base side wall. The second external portion is vertically spaced from and extends laterally outward relative to the second internal portion. The container includes a button latch having a male button formed in one of the first and second internal flange portions and a mating female recess formed in the other of the first and second internal flange portions. The male button is adapted to engage within the female recess.

In accordance with another aspect of the present invention, the lid side wall includes a plurality of facets interconnected at corners. The corners are arced outwardly in radial cross-sections taken generally perpendicular to the top wall and through the respective corners. The facets are arced inwardly in a cross-section taken generally parallel to the top wall and through the facets.

The above summary of the present invention is not intended to represent each embodiment, or every aspect of the present invention. This is the purpose of the figures and detailed description which follow.

BRIEF DESCRIPTION OF THE DRAWINGS

Other objects and advantages of the invention will become apparent upon reading the following detailed description and upon reference to the drawings in which.

Figure 1:
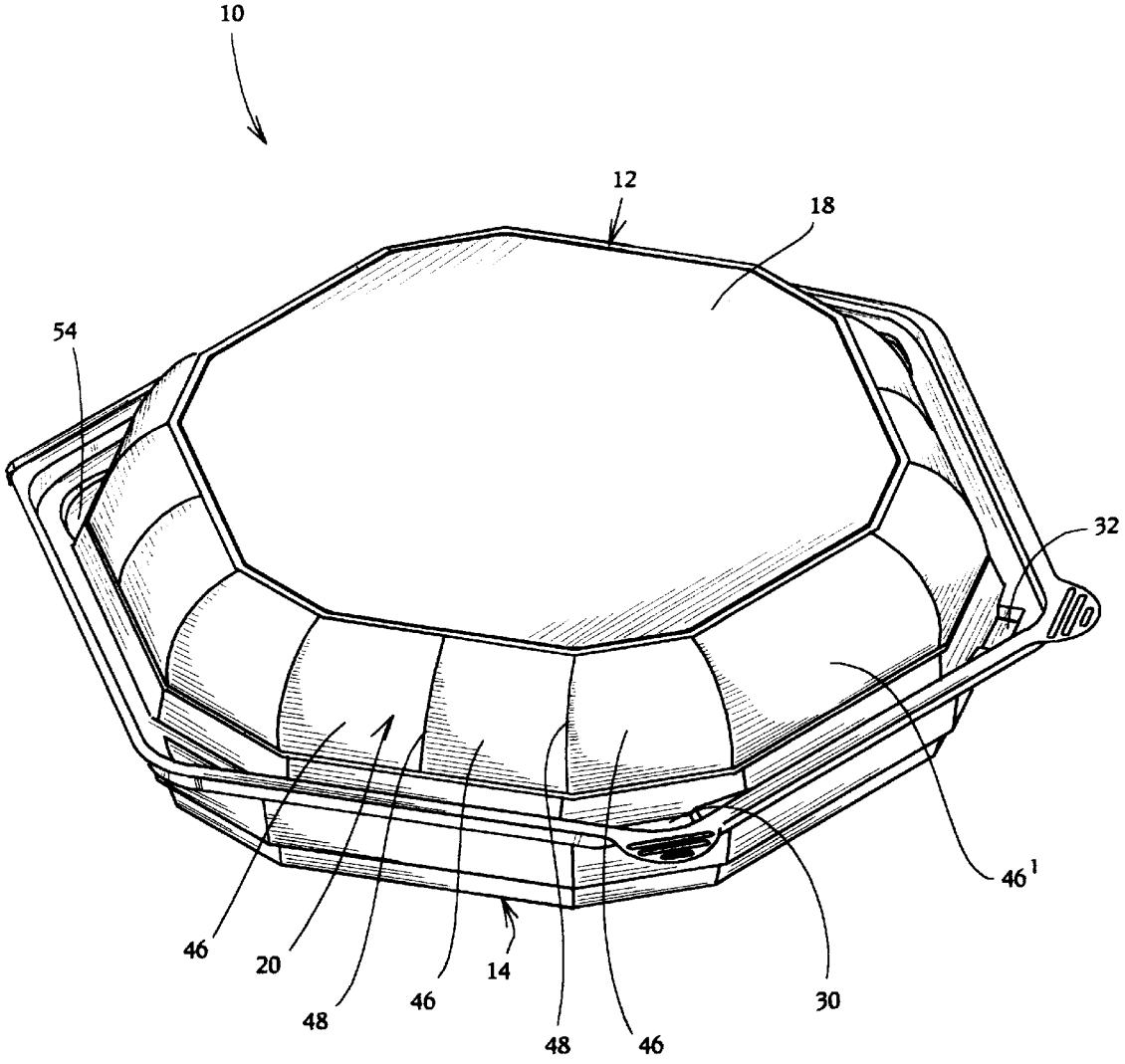
FIG. 1 is an isometric view of a plastic food container embodying the present invention showing the container in a closed position.

While the invention is susceptible to various modifications and alternative forms, certain specific embodiments thereof have been shown by way of example in the drawings and will be described in detail. It should be understood, however, that the intention is not to limit the invention to the particular forms described. On the contrary, the intention is to cover all modifications, equivalents, and alternatives falling within the spirit and scope of the invention as defined by the appended claims.

DESCRIPTION OF ILLUSTRATIVE EMBODIMENTS

Figure 2:
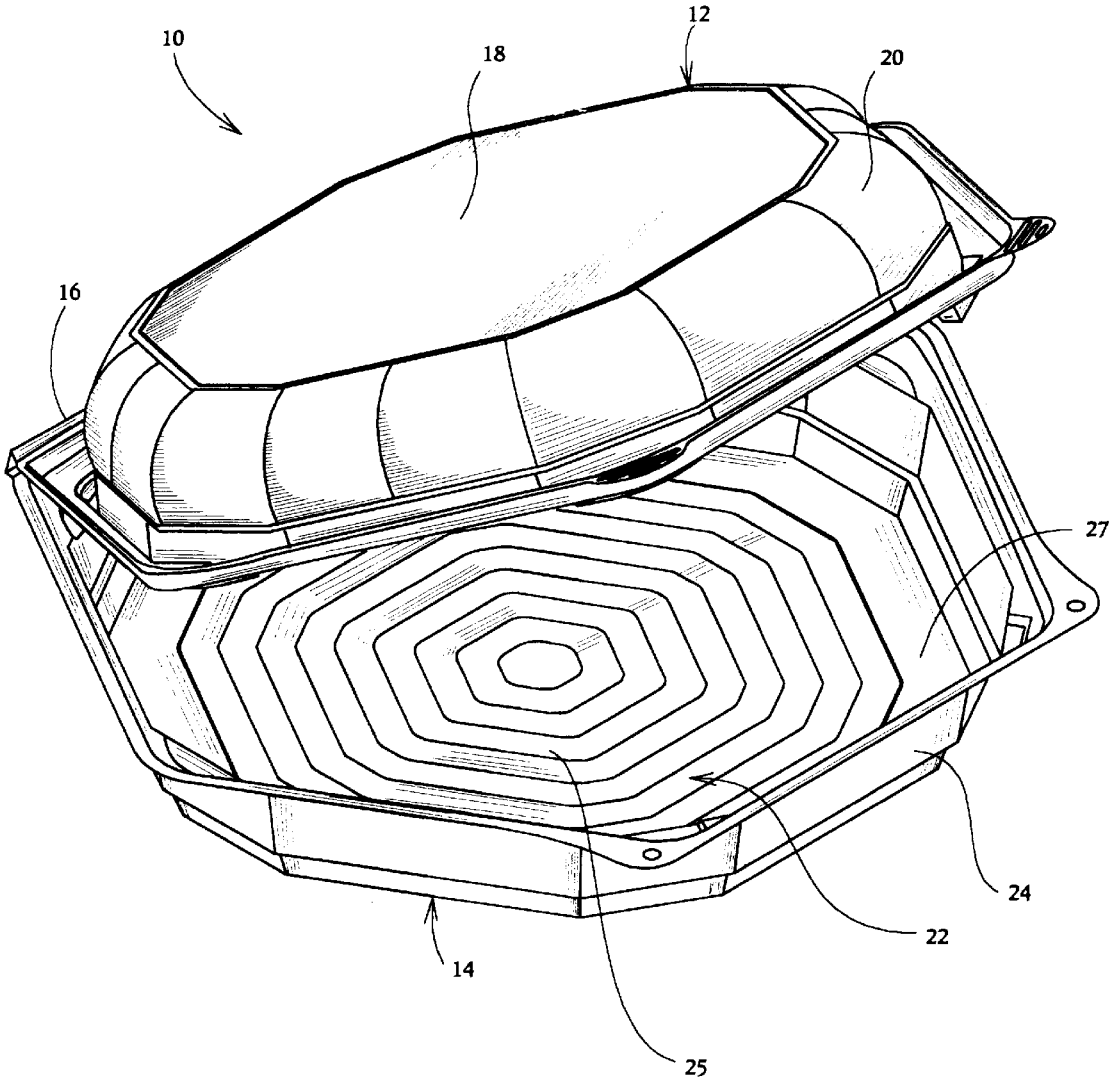
FIG. 2 is an isometric view of the container in an open position.

Turning now to the drawings, FIGS. 1 and 2 depict a plastic container 10 including a lid 12 and a base 14. The container 10 is composed of a thermoplastic material such as oriented polystyrene, polyethylene terephthalate, polypropylene, or other polymeric materials having a thickness ranging from about 0.010 inch to about 0.050 inch. To facilitate viewing of food within the container 10, the thickness of the lid 12 is preferably toward the lower end of the foregoing range and the lid material is transparent. The base material may be transparent or opaque, depending upon the application for which the container 10 is intended. As best shown in FIG. 2, the lid 12 is hingedly connected to the base 14 along a hinge 16. The lid 12 includes a top wall 18 and a lid side wall 20 extending downward from the top wall 18. The base 14 includes a bottom wall 22 and a base side wall 24 extending upward from the bottom wall 22. FIGS. 3–7 depict other views of the container 10.

Referring to FIG. 2, the bottom wall 22 of the base 14 forms a raised food platform 25 encompassed by a trough 27. The food platform 25 allows food within the container 10 to be aesthetically displayed at the center of the base 14. The trough 27, which is disposed between the food platform 25 and the base side walls 24, provides a region to which the fluids of the food can flow thereby preventing the food from sitting in fluid. The normal motions due to handling and transport shift the fluids from the food and into the trough 27 where they are captured. Thus, the food platform 25 can be substantially horizontal or slightly angled in the downward direction toward the trough 27 such that fluids flow to the trough 27 under the force of gravity. Alternatively, the food platform 25 could have small channels situated below the surface of the food platform 25 which slope to the trough 27 such that the fluid flow path would not be hindered by the food congregated on the food platform 25.

The food platform 25 also serves the purpose of providing rigidity when the base 14 is loaded with food and being handled. The food platform 25 acts as a structural rib on the bottom wall 22 of the base 14 and resists the tendency of the base 14 to bow downwardly when holding food. Additionally, the corners joining the polygonal sides of the food platform 25 transfer stresses between adjacent ones of the polygonal sides, thereby reducing the stress concentration on the polygonal sides of the food platform 25.

In addition, to allow for stacking of multiple closed containers, the food platform 25 forms a stacking recess adapted to receive a mating projection formed by the top wall of a closed identical container positioned beneath the container 10. When the stacking projection of the lower identical container is positioned within the stacking recess formed by the food platform 25 of the container 10, the vertically stacked containers will not slide relative to each other.

Multiple empty containers may be shipped to a customer by nesting open containers and packing the nested containers in a shipping box. To facilitate separation of the nested containers as the customer removes the containers from the shipping box, ridges or textured surfaces may be applied to the base side wall 24. The ridges or textured surfaces permit the customer to easily grasp the containers during the denesting process.

Referring to FIGS. 8–12, the lid 12 includes a first stepped flange 26 extending laterally outward from a lower portion of the lid side wall 20. The stepped flange 26 includes an internal portion 26*a*, an external portion 26*b*, and a bridge 26*c*. The internal portion 26*a* extends laterally outward from the lower portion of the lid side wall 20. The external portion 26*b* is vertically spaced above the internal portion 26*a* and is coupled to the internal portion 26*a* by the generally vertical bridge 26*c*. The external portion 26*b* extends laterally outward from the bridge 26*c*.

Likewise, the base 14 includes a second stepped flange 28 extending laterally outward from an upper portion of the base side wall 24. The stepped flange 28 includes an internal portion 28*a*, an external portion 28*b*, and a bridge 28*c*. The internal portion 28*a* extends laterally outward from the upper portion of the base side wall 24. The external portion 28*b* is vertically spaced above the internal portion 28*a* and is coupled to the internal portion 28*a* by the generally vertical bridge 28*c*. The external portion 28*b* extends laterally outward from the bridge 28*c*.

The container 10 includes a double-locking system for securing latching the container 10 in a closed position (FIG. 1) and preventing food juices from leaking out of the container 10. A first locking mechanism is created by a perimeter undercut seal along the bridges 26*c* and 28*c* of the respective stepped flanges 26 and 28. As best shown in FIGS. 8–12, the bridges 26*c* and 28*c* are angled in a slightly inward direction as they extend from the respective internal portions 26*a* and 28*a* to the respective external portions 26*b* and 28*b*. Therefore, when the lid 12 is rotated from the open position in FIG. 1 to the closed position in FIG. 2, the stepped flange 26 snappingly engages the stepped flange 28 along the bridges 26*c* and 28*c* as the juncture of the internal portion 26*a* and the bridge 26*c* is forced past the juncture of the bridge 28*c* and the external portion 28*b*. This undercut locking mechanism provides a fairly secure closure and leak resistance. To keep the undercut locking mechanism intact and provide additional closure secureness without increasing the size of the container 10, a second locking mechanism is created by a pair of internal/inboard button latches. As discussed below, the button latches are located inboard relative to the full perimeter undercut seal.

Figure 3:
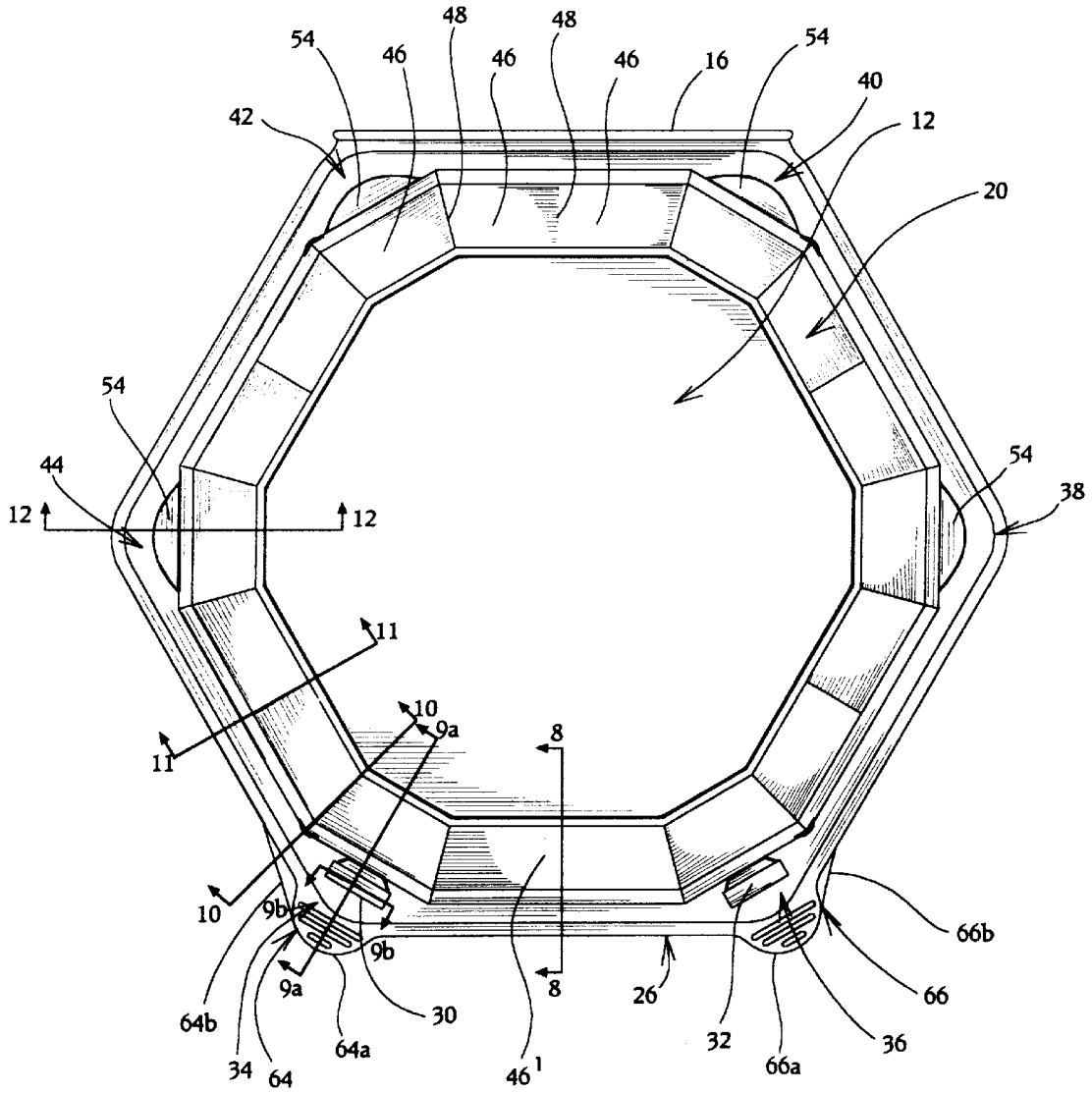
FIG. 3 is a top view of the container.
Figure 4:
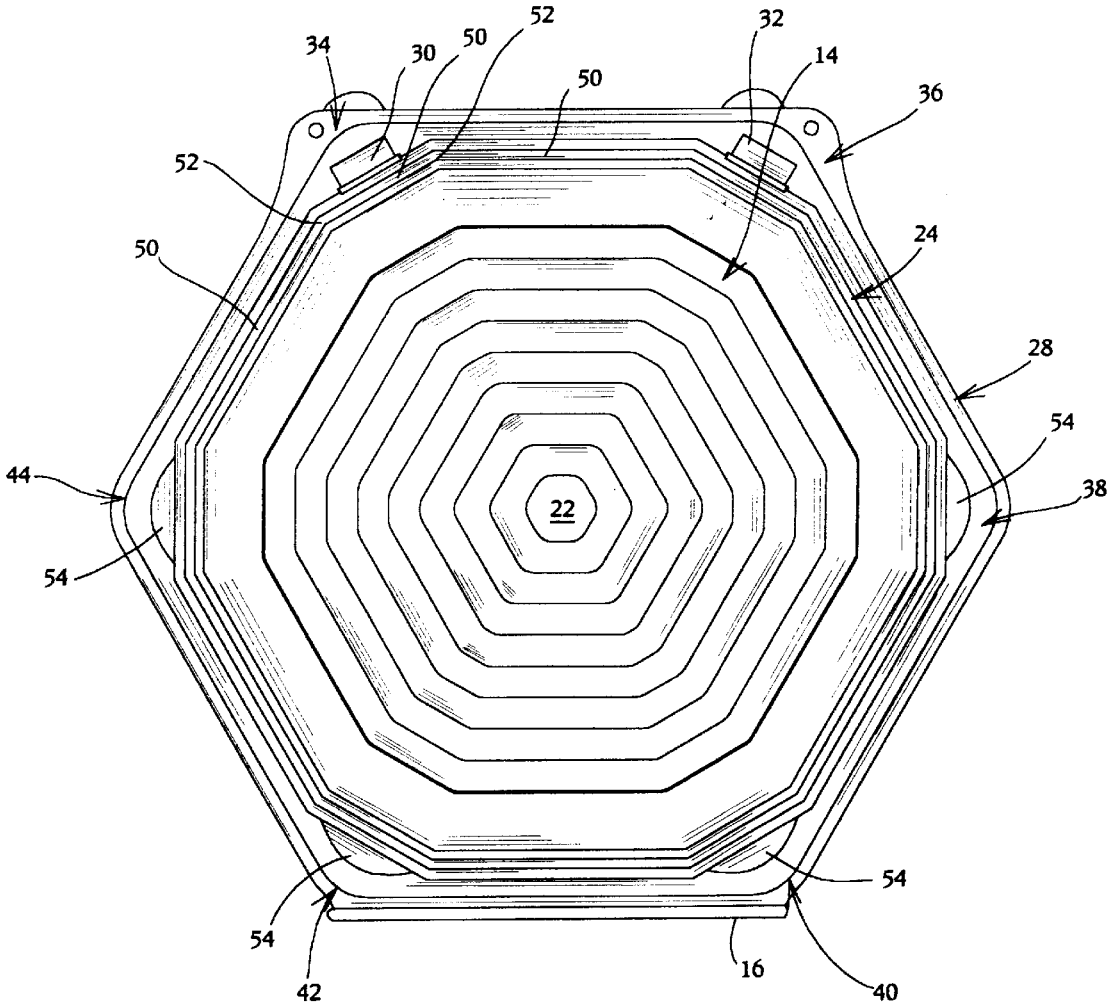
FIG. 4 is a bottom view of the container.

Referring to FIGS. 3 and 4, in cooperation with the shapes of the lid side wall 20 and the base side wall 24, the stepped flanges 26 and 28 are shaped to easily accommodate the pair of internal button latches 30 and 32. More specifically, the stepped flanges 26 and 28 define a polygon having a plurality of corners. In a preferred embodiment, the polygon has six sides defining the six corners 34, 36, 38, 40, 42, and 44. The lid side wall 20 (FIG. 3) includes a plurality of facets 46 interconnected at lid side wall corners 48. In a preferred embodiment, there are twelve facets 46 interconnected at twelve lid side wall corners 48. The base side wall 24 (FIG. 4) likewise includes a plurality of facets 50 interconnected at base side wall corners 52. In a preferred embodiment, there are twelve facets 50 interconnected at twelve base side wall corners 52. Of course, the number of facets and corners on the lid 12 and the base 14 may vary depending upon the size of the container 10. As illustrated in FIGS. 3 and 4, the flange corners 34, 36, 38, 40, 42, and 44 are aligned with the side wall facets 46 and 50, not the side wall corners 48 and 52. Consequently, the area of the internal flange portions 26*a* and 28*a* is relatively large at the flange corners 34, 36, 38, 40, 42, and 44 (see FIGS. 9 and 12) compared to the area of the internal flange portions along the sides of the polygon defined by the stepped flanges (see FIGS. 8 and 11). These large corner flange areas can easily accommodate such features as the internal button latches 30 and 32 at the respective corners 34 and 36 and mating protrusion/recess combinations 54 at the remaining corners 38, 40, 42, and 44. By placing the foregoing features on the internal flange portions 26*a* and 28*a*, the external flange portions 26*b* and 28*b* can be kept small to minimize the size of the container 10.

Figure 12:
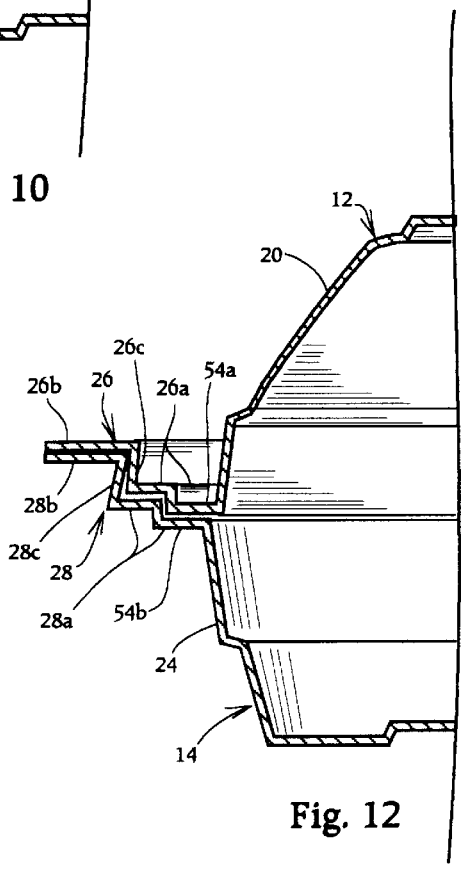
FIG. 12 is a section view taken generally along line 12—12 in FIG. 3.

FIG. 12 illustrates a cross-section of one of the mating protrusion/recess combinations 54, which is located at the flange corner 44. The combinations 54 at the other flange corners are identical to the combination 54 depicted in FIG. 12. The combination 54 includes a protrusion 54*a* on the lid 12 and a recess 54*b* on the base 14. When the lid 12 is in the closed position in FIG. 1, the protrusion 54*a* is retained within the recess 54*b* and prohibited from moving therefrom. Top load forces on the lid 12 are easily transmitted into the base 14 via the combination 54. This reduces the force transferred through the peripheral undercut locking mechanism between the lid 12 and the base 14 which, in turn, minimizes the risk that the lid 12 will detach from the base 14. Further, the combination 54 transfers side load forces around the flange corner 44 to the nearby facets 46 on the lid side wall 20 and the nearby facets 50 of the base side wall 24. The shape of the combinations 54 may be varied from that shown in FIGS. 3 and 4. Further information concerning the combinations 54 may be obtained from copending U.S. patent application Ser. No. 08/514,534 to Hayes et al. entitled "Catering Container Assembly," assigned to the instant assignee, and incorporated herein by reference in its entirety.

Figure 9A:
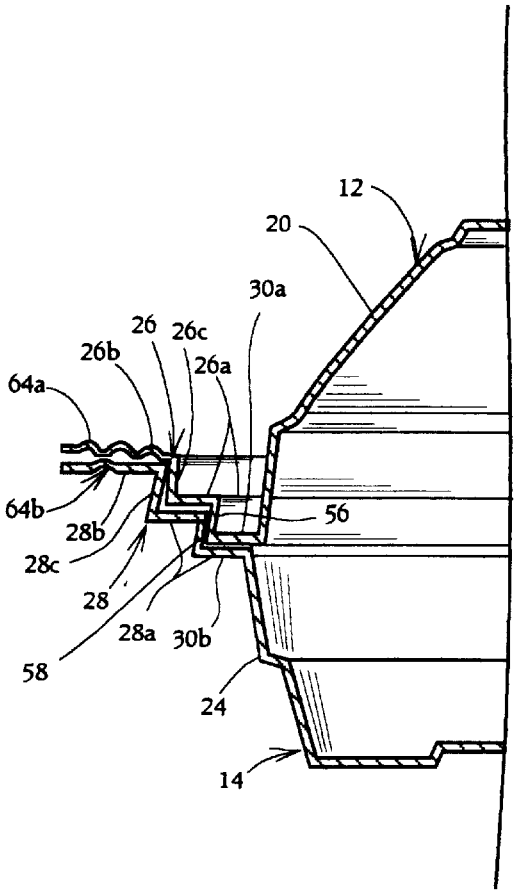
FIG. 9*a* is a section view taken generally along line 9*a*—9*a* in FIG. 3.
Figure 9B:
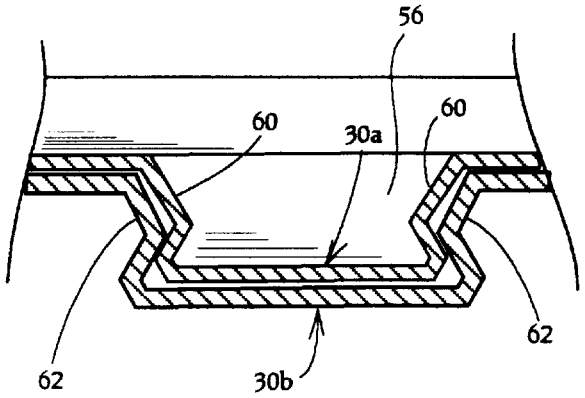
FIG. 9*b* is a section view taken generally along line 9*b*—9*b* in FIG. 3.

FIGS. 9*a* and 9*b* illustrate cross-sections of the button latch 30, which is located at the flange corner 34. The button latch 32 at the flange corner 36 is identical to the button latch 30 depicted in FIGS. 9*a* and 9*b*. The button latch 30 includes a downwardly extending male button 30*a* and a mating female recess 30*b*. The male button 30*a* is formed by the internal portion 26*a* of the stepped flange 26, while the female recess 30*b* is formed by the internal portion 28*a* of the stepped flange 28. It is contemplated that the locations of the male button 30*a* and the female recess 30*b* could be reversed such that an upwardly extending male button is formed by the internal portion 28*a* of the stepped flange 28 and a mating female recess is formed by the internal portion 26*a* of the stepped flange 26.

The button latch 30 is elongated in a direction parallel to the adjacent facets 46 and 50 on the respective lid 12 and base 14 (see FIG. 3). In a preferred embodiment, locking takes place at the short ends of the elongated latch 30 rather than along the relatively long sides of the latch 30. Accordingly, referring to FIG. 9*a*, the long sides 56 of the male button 30*a* and the long sides 58 of the female recess 30*b* are substantially straight and free of any interlocking shoulder structures. Referring to FIG. 9*b*, the short opposite ends 60 of the elongated male button 30*a* form shoulders adapted to snappingly engage with corresponding shoulders at the short opposite ends 62 of the female recess 30*b*. In addition to providing the container 10 with additional closure secureness, the button latches 30 and 32 serve the same function as the protrusion/recess combinations 54 described above. Further information concerning the button latches 30 and 32 may be obtained from U.S. Pat. No. 5,046,659 to Warburton, which is incorporated herein by reference in its entirety.

Referring to FIG. 3, to facilitate opening the container 10 from the closed position, the external flange portions 26*b* and 28*b* form a pair of opening tab structures 64 and 66 located at the respective flange corners 34 and 36. The tab structures 64 and 66 are preferably located at the same flange corners as the button latches 30 and 32 so that the button latches 30 and 32 are more easily disengaged. Each opening tab structure includes a pair of laterally offset tabs. For example, the opening tab structure 64 includes the offset tabs 64*a* and 64*b*. The lid tab 64*a* is formed by the external flange portion 26*b*, while the base tab 64*b* is formed by the external flange portion 28*b*. The lid tab 64*a* preferably includes raised ribs for improved gripping, and the base tab 64*b* includes a raised nib to pre-separate the tabs 64*a* and 64*b* (FIG. 9*a*).

Figure 10:
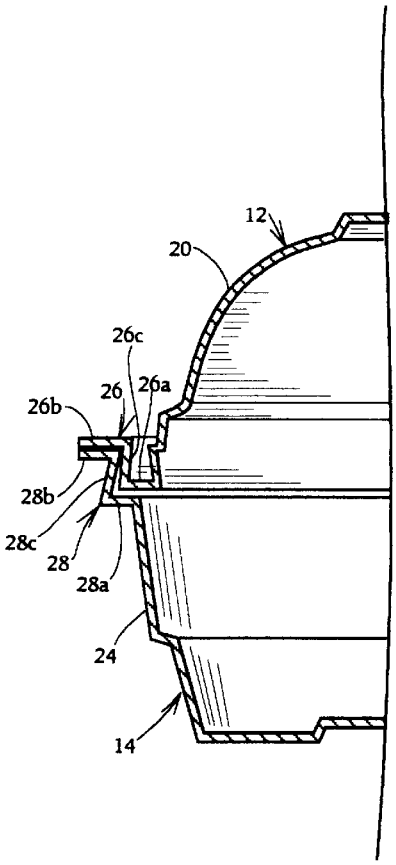
FIG. 10 is a section view taken generally along line 10—10 in FIG. 3.
Figure 11:
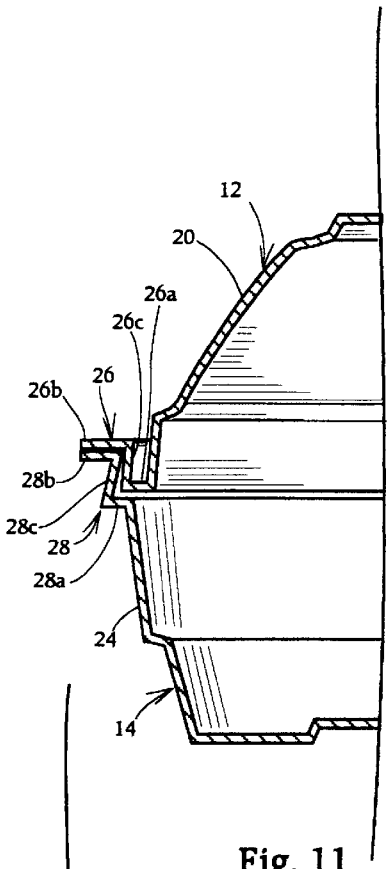
FIG. 11 is a section view taken generally along line 11—11 in FIG. 3.
Figure 13:
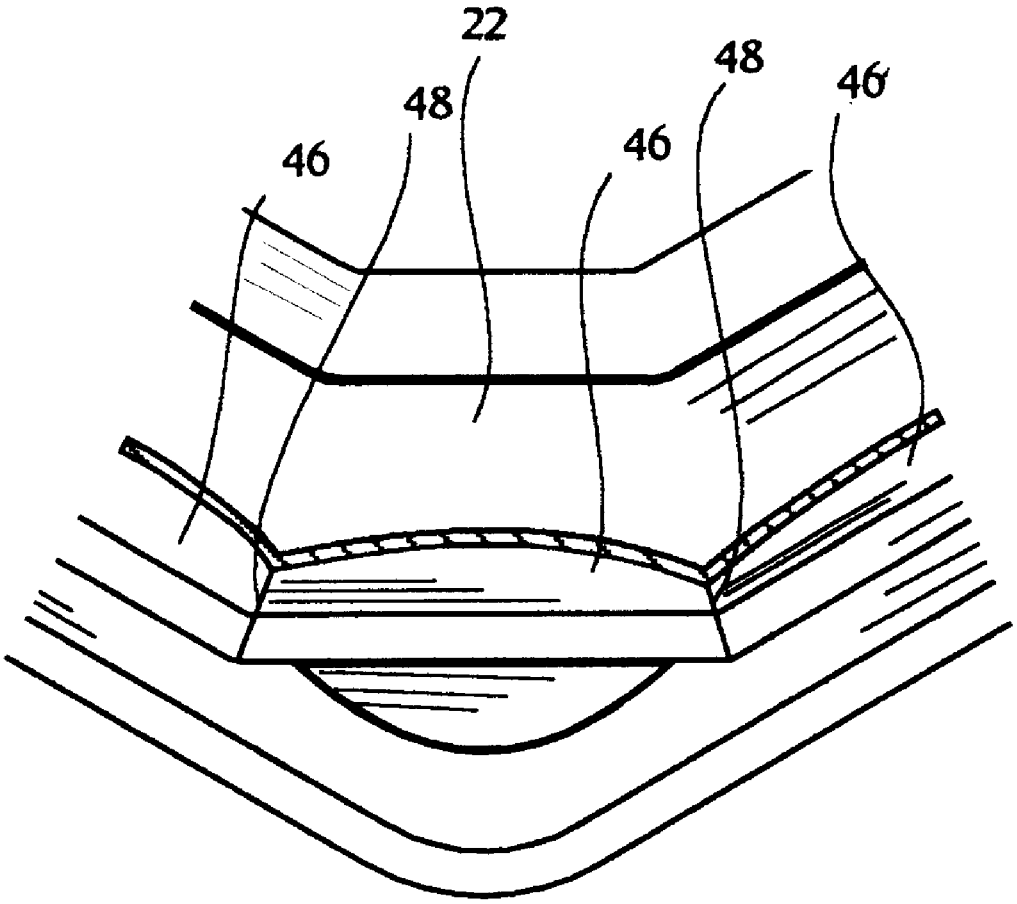
FIG. 13 is a section view taken generally along line 13—13 in FIG. 6.

Referring to FIGS. 1 and 3, to enhance the strength of the lid 12 without thickening the plastic material from which it is formed, the lid side wall 20 is specially designed to resist top loads (top-to-bottom crushing) and side loads (side wall crushing). Top loads typically occur when the container 10 is stacked on a shelf, while side loads typically occur when the container 10 is handled. Specifically, in radial cross-sections taken generally perpendicular to the top wall 18 and through the facets 46, the facets 46 are generally linear at their horizontal mid-point (FIGS. 9*a*, 11, and 12) and become more and more outwardly arced as the radial cross-sections approach the lid side wall corners 48 joining the facets 46. The degree of outward arcing is greatest at the corners 48 where in a preferred embodiment the radius of curvature can range from about 0.5 inches to about 3.0 inches depending upon the height of the lid side wall 20. FIG. 10 depicts a radial cross-section through one of the corners 48. Furthermore, in cross-sections taken generally parallel to the top wall 18, the facets 46 are generally linear at their uppermost and lowermost ends and become more and more inwardly arced as the cross-sections approach their approximate vertical mid-point (FIG. 13). The degree of inward arcing is greatest at the approximate vertical mid-point of each facet 46, where in a preferred embodiment the radius of curvature can range from about 2.0 to about 3.0 inches. FIG. 13 depicts a cross-section through the vertical mid-point of one of the facets 46. The above facet configuration greatly allows the lid 12 to resist vertical forces exerted on the top wall 18 of the lid 12 and lateral forces exerted on the lid side wall 20.

Figure 5:
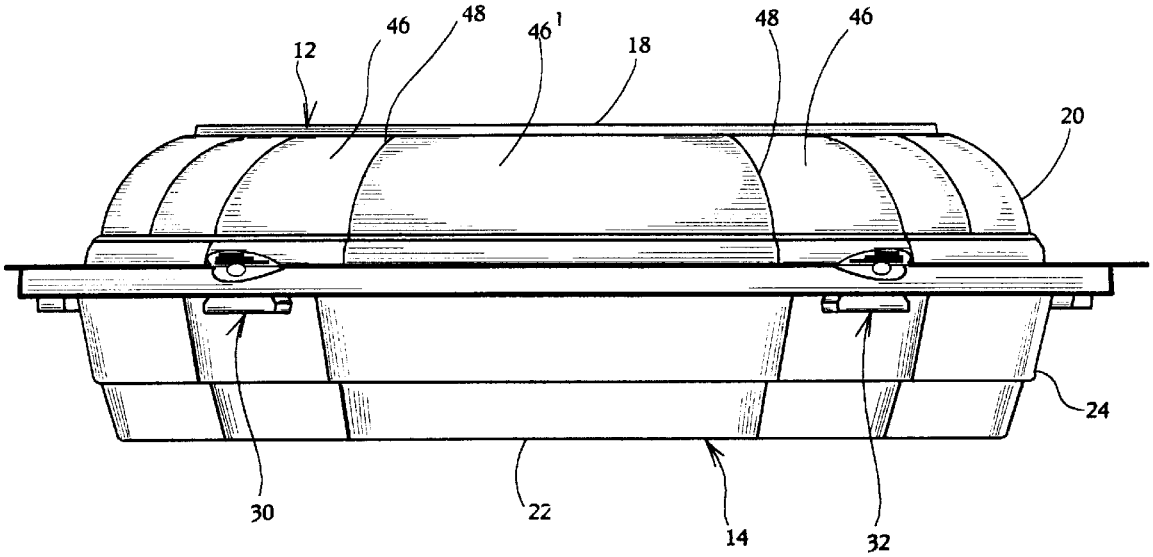
FIG. 5 is a front view of the container.
Figure 6:
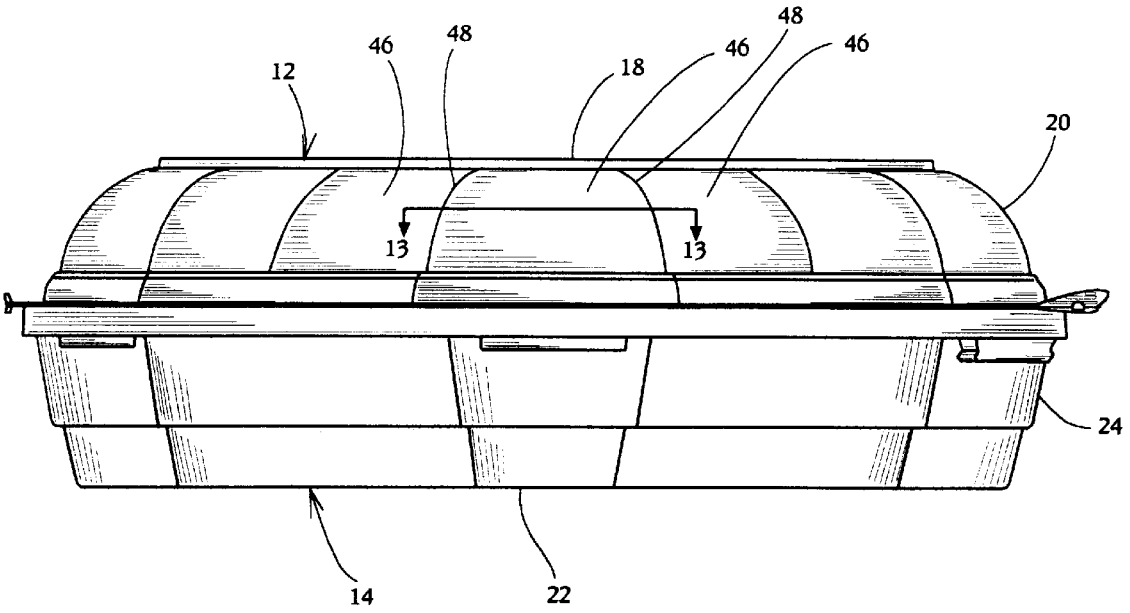
FIG. 6 is a side view of the container.
Figure 7:
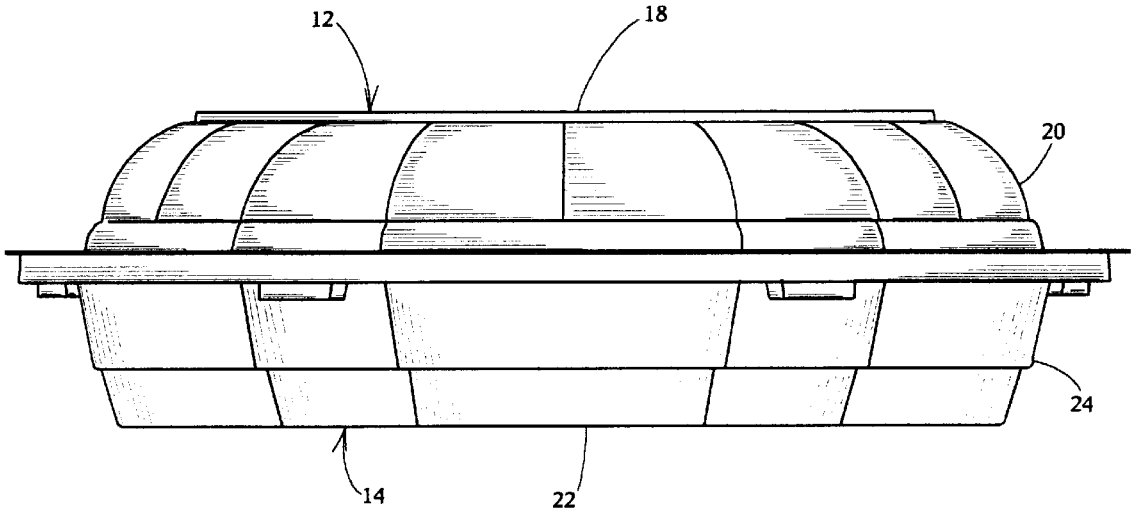
FIG. 7 is a rear view of the container.
Figure 8:
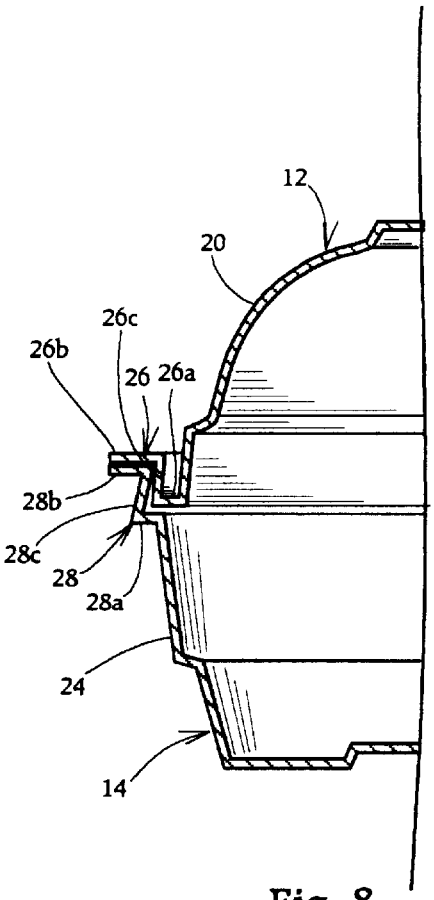
FIG. 8 is a section view taken generally along line 8—8 in FIG. 3.

One of the facets 46' on the lid side wall 20 is not inwardly arced as described above, but rather is linear in all cross-sections taken generally parallel to the top wall 18. This provides the facet 46' with a "flat" surface (albeit outwardly arced in vertical cross-section) suitable for receiving an adhesive label having product and price information. As shown in FIG. 5, the facet 46' is located along the front of the lid side wall 20 between the button latches 30 and 32.

While the present invention has been described with reference to one or more particular embodiments, those skilled in the art will recognize that many changes may be made thereto without departing from the spirit and scope of the present invention. For example, the hinge 16 may be removed so that the lid 12 and the base 14 are not permanently connected to each other. In this case, the container 10 is provided with additional button latches at the flange corners 40 and 42. In another embodiment, the lid 12 and the base 14 include partition members for dividing the container 10 into multiple food compartments. Each of these embodiments and obvious variations thereof is contemplated as falling within the spirit and scope of the claimed invention, which is set forth in the following claims.

What is claimed is:

1. A plastic container comprising:

a lid including a top wall, a lid side wall, and a first stepped flange, said lid side wall extending downward from said top wall, said first stepped flange extending laterally outward from a lower portion of said lid side wall, said first stepped flange including a first internal portion and a first external portion, said first internal portion extending laterally outward from said lower portion of said lid side wall, said first external portion being vertically spaced from and extending laterally outward relative to said first internal portion;

a base including a bottom wall, a base side wall, and a second stepped flange, said base side wall extending upward from said bottom wall, said second stepped flange extending laterally outward from an upper portion of said base side wall, said second stepped flange including a second internal portion and a second external portion adapted to oppose said respective first internal portion and the first external portion, said second internal portion extending laterally outward from said upper portion of said base side wall, said second external portion being vertically spaced from and extending laterally outward relative to said second internal portion; and a button latch having a male button formed in one of said first and second internal flange portions and a mating female recess formed in the other of said first and second internal flange portions, said male button being adapted to engage within said female recess.

2. The container of claim 1, wherein first and second stepped flanges form respective undercuts extending along a periphery of the container, said undercuts being releasably engageable to each other.

3. The container of claim 2, wherein said first internal portion is coupled to said first external portion by a first generally vertical bridge and wherein said second internal portion is coupled to said second external portion by a second generally vertical bridge, said first and second bridges being slightly angled to form said respective undercuts.

4. The container of claim 3, wherein said first and second bridges are angled in a slightly inward direction toward an interior of the container as said first and second bridges extend from said respective first and second internal portions to said respective first and second external portions.

5. The container of claim 3, wherein said first external portion is vertically spaced above said first internal portion and wherein said second external portion is vertically spaced above said second internal portion.

6. The container of claim 1, wherein said first and second stepped flanges define a polygon having a plurality of flange corners, said button latch being located at one of said flange corners.

7. The container of claim 6, wherein said lid side wall includes a plurality of facets, said flange corners being aligned with respective ones of said facets.

8. The container of claim 7, wherein said facets are interconnected at lid side wall corners, said flange corners not being aligned with said lid side wall corners.

9. The container of claim 7, wherein said button latch is elongated in a direction parallel to an adjacent one of said facets.

10. The container of claim 6, wherein said first and second internal portions are larger in area at said flange corners than away from said flange corners, thereby allowing said one of said flange corners to easily accommodate said button latch.

11. A plastic container comprising:

a lid including a top wall, a lid side wall, and a first stepped flange, said lid side wall extending downward from said top wall, said first stepped flange extending laterally outward from a lower portion of said lid side wall, said first stepped flange including a first internal portion extending laterally outward from said lower portion of said lid side wall, said first internal portion being recessed relative to an external portion of said first stepped flange;

a base including a bottom wall, a base side wall, and a second stepped flange, said base side wall extending upward from said bottom wall, said second stepped flange extending laterally outward from an upper portion of said base side wall, said second stepped flange including a second internal portion adapted to oppose said first internal portion, said second internal portion extending laterally outward from said upper portion of said base side wall and being recessed relative to an external portion of said second stepped flange; and a button latch having a male button formed in one of said first and second internal flange portions and a mating female recess formed in the other of said first and second internal flange portions, said male button being adapted to engage within said female recess.

12. The container of claim 11, wherein first and second stepped flanges form respective undercuts extending along a periphery of the container, said undercuts being releasably engageable to each other.

13. The container of claim 12, wherein undercuts are formed by steps in said respective first and second stepped flanges.

14. The container of claim 12, wherein said button latch is positioned laterally inward relative to an adjacent portion of said undercuts.

15. The container of claim 12, wherein said undercuts of said respective first and second stepped flanges extend continuously along the entire periphery of the container.

16. The container of claim 11, wherein said first and second stepped flanges define a polygon having a plurality of flange corners, said button latch being located at one of said flange corners.

17. The container of claim 16, wherein said lid side wall includes a plurality of facets, said flange corners being aligned with respective ones of said facets.

18. The container of claim 16, wherein said first and second internal portions are larger in area at said flange corners than away from said flange corners, thereby allowing said one of said flange corners to easily accommodate said button latch.

19. A plastic container comprising:

a lid including a top wall and a lid side wall extending downward from said top wall, said lid side wall including a plurality of facets interconnected at corners, said corners being outwardly arced in radial cross-sections taken generally perpendicular to said top wall and through said respective corners, said facets being inwardly arced in a cross-section taken generally parallel to said top wall and through said facets; and a base including a bottom wall and a base side wall extending upward from said bottom wall.

20. The container of claim 19, wherein said facets are generally linear in radial cross-sections taken generally perpendicular to said top wall and through respective horizontal mid-points of said facets.

21. The container of claim 20, wherein in radial cross-sections taken generally perpendicular to said top wall and through said facets, said facets gradually become more outwardly arced as the radial cross-sections move away from said horizontal mid-points and approach said corners.

22. The container of claim 19, wherein in cross-sections taken generally parallel to the top wall and through said facets, said facets are generally linear at uppermost and lowermost ends thereof and gradually become more inwardly arced as the cross-sections approach respective approximate vertical mid-points of said facets.

23. The container of claim 21, wherein in cross-sections taken generally parallel to the top wall and through said facets, said facets are generally linear at uppermost and lowermost ends thereof and gradually become more inwardly arced as the cross-sections approach respective approximate vertical mid-points of said facets.

* * * * *